United States Patent [19]

Kai et al.

[11] 4,321,210

[45] Mar. 23, 1982

[54] CONVERSION OF CYCLOPROPENOIDS TO CONJUGATED DIENE AND SATURATED DERIVATIVES

[75] Inventors: Yoshinori Kai, Atsugi, Japan; Everett H. Pryde, Peoria, Ill.

[73] Assignee: The United States of America as represented by the Secretary of Agriculture, Washington, D.C.

[21] Appl. No.: 263,823

[22] Filed: May 15, 1981

[51] Int. Cl.[3] ..... C11C 3/14

[52] U.S. Cl. ..... 260/409; 260/405.6

[58] Field of Search ..... 260/405.6, 409

[56] References Cited

U.S. PATENT DOCUMENTS 3,201,431 8/1965 Merker et al. ..... 260/409

OTHER PUBLICATIONS

D. V. Kinsman, "Isostearic and Other Branched Acids," JAOCS 56(11): 823A–827 A (1979).

Hutchins et al., "A New Process for the Selective Hydrogenation of Cyclopropenoids in Cottonseed Oil," JAOCS 45(5): 397–399 (1968).

Zarins et al., "Reaction of Cyclopropene Esters with Hydrogenation Catalysts," JAOCS 47(6): 215–218 (1970).

Shimadate et al., "The Isomerization of 1,2-Di-n-octylcyclopropene with Alumina," J. Org. Chem. 29(2): 485–487 (1964).

*Primary Examiner*—John F. Niebling

*Attorney, Agent, or Firm*—M. Howard Silverstein; David G. McConnell; Curtis P. Ribando

[57] ABSTRACT

Cyclopropenoid compounds such as malvalic and sterculic fatty acids found in sterculia oil are rearranged substantially quantitatively to conjugated dienes when heated in the presence of a rhodium catalyst. The dienes can thereafter be reduced to the corresponding branched chain derivatives by means of hydrogenation with the same catalyst. Both the diene and branched derivatives have application in the production of plastics, coatings, lubricants, soaps, cosmetics, and other commercial products.

13 Claims, No Drawings

CONVERSION OF CYCLOPROPENOIDS TO CONJUGATED DIENE AND SATURATED DERIVATIVES

BACKGROUND OF THE INVENTION

1. Field of the Invention

Two naturally occurring cyclopropenoid acids, sterculic and malvalic, comprise approximately 61% of the seed oils of *Sterculia foetida,* and are also present in lesser amounts in the seed oils of *Hisbiscus syriacus, Lavatera trimestris,* and *Brachychiton populneum.* In sterculia oil the cyclopropenoid distribution is about 54% sterculic and 7% malvalic, while in the other seed oils, malvalic predominates. These acids have also been reported in minor amounts in the leaf oils of two Malva species and at levels of up to about 3% in cottonseed oil. When cottonseed oil is incorporated into the diet of laying hens, it often causes a pinkish discoloration of the egg whites as well as an increased level of chick mortality. Prior interest in these compounds has therefore been primarily directed to elimination of the cyclopropenoid functionality. However, pending the development of a feasible conversion procedure, these compounds have commercial potential as a source of conjugated dienes and saturated branched chain fatty acids. Such compounds are useful in the production of plastics, coatings, lubricants, soaps, cosmetics, and other industrial and consumer products as summarized for example by Kinsman [JAOCS 56(11): 823A–827A (1979)]. This invention relates to a novel process for the catalytic rearrangement of these and other cyclopropenoid compounds to conjugated dienes and additionally to a catalytic hydrogenation for converting the dienes to their saturated branched chain counterparts.

DESCRIPTION OF THE PRIOR ART

As mentioned above, most prior research on cyclopropenoid acids has concentrated on their inactivation in cottonseed oil. Merker et al., U.S. Pat. No. 3,201,431, teaches a hydrogenation process of which malvalic and sterculic acids are selectively reduced by means of a nickel catalyst to their dihydro or tetrahydro derivatives without significant reduction of the linoleic acid or trans acid formation. Hutchins et al. [JAOCS 45(5): 397–399 (1968)] show selectively hydrogenating the cyclopropenoid groups in cottonseed oil by means of a packed-bed reactor and nickel catalysts under milder conditions and for a shorter reaction time than required by Merker. Other catalysts including platinum, palladium, rhodium, and ruthenium were shown to have been unsatisfactory due to considerable reduction of the total unsaturation of the oil. Zarins et al. [JAOCS 47(6): 215–218 (1970)] investigated the effect of treating cottonseed oil and methyl esters of sterculic and malvalic acids with various hydrogenation catalysts but in the absence of hydrogen. The catalysts included several forms each of palladium, nickel, platinum, and carbon, as well as alumina. The palladium catalysts alone were found to significantly inactivate the cyclopropenes by conversion to a mixture of polymers and methyl- and methylene-substituted esters. When pure methyl sterculate was heated with the catalyst, the polymer content was about 50%, but when the ester was reacted as a 5% solution in decane, the polymer content was reduced to 25%. Other components in the starting oil appeared to be unaffected. Shimadate et al. [J. Org. Chem. 29(2): 485–487 (1964)] teaches that sterculene (1,2-di-n-octylcyclopropene) can be similarly converted by means of alumina catalyst under nitrogen with 50–55% of the product being in the form of the methyl- or methylene-branched chains, and the remainder being polymerized or otherwise rearranged. The relatively high degree of polymerization associated with the rearrangement reaction would be expected from the commercial method of preparing dimeric and trimeric fatty acids by heating unsaturated acids in the presence of a catalyst. By-products of the latter procedure are hydrogenated to produce a branched acid mixture commonly referred to as isostearic acid. As shown in FIG. 2 of Kinsman, supra, the branching found in commercial isostearic acid is typically scattered along the full length of the chain.

SUMMARY OF THE INVENTION

We have now unexpectedly discovered that when cyclopropenoid compounds are heated in the presence of a rhodium catalyst in an inert atmosphere, they are rearranged substantially quantitatively to conjugated dienes. The dienes may either be recovered, or else reduced by rhodium-catalyzed hydrogenation to their saturated, branched chain counterparts. Of particular interest is the treatment of malvalic and sterculic acids and their alkyl and triglyceride esters.

In accordance with this discovery, it is an object of the invention to provide a commercially feasible method for converting cyclopropenoid compounds to economically important derivatives.

It is also an object of the invention to quantitatively rearrange the cyclopropene structure to a limited array of conjugated diene isomers without significant polymerization or occurrence of side reactions.

Another object of the invention is to provide an alternative source and practical method for obtaining branched chain compounds, especially branched chain fatty acids and fatty acid esters.

A further object of the invention is to efficiently convert cyclopropenoid compounds to their branched chain derivatives by a simple, two-step, single-catalyst process.

Other objects and advantages of the invention will become readily apparent from the ensuing description.

DETAILED DESCRIPTION OF THE INVENTION

The starting compounds contemplated within the scope of the invention include all straight, branched, or cyclic cyclopropenoid compounds having at least one carbon atom adjacent to one of the double-bonded carbons in the cyclopropene ring, provided that the compound does not contain any other functional groups which would significantly interfere with the catalyst. These compounds are characterized by the following general formula:

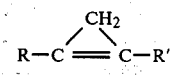

wherein R and R′ are independently selected from hydrogen, methyl, and substituted or unsubstituted alkyl radicals, or where R and R′ are joined to form a cyclic structure, with the proviso that R and R′ are not both hydrogen. Exemplary of such compounds are the aforementioned malvalic and sterculic acids or their esters having the following structures:

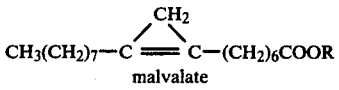

malvalate

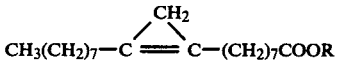

wherein R is hydrogen or an ester moiety which will not interfere with the catalyst. In order to minimize side reactions, particularly during the hydrogenation step, it is preferred that the cyclopropenoid acids be in the esterified form. For instance, a suitable starting material would be sterculia oil or other triglyceride comprising malvalate, sterculate, or mixtures thereof. It is noted that most noncyclopropenoid components of such oils will typically be compatible with the pursuant reactions, but if unsaturated, they would be susceptible to reduction during the hydrogenation. Alternatively, the starting material may be a simple ester of one or more of the cyclopropenoid acids. Lower alkyl esters such as methyl and ethyl are preferred, though longer chain straight or substituted groups intended to be retained in the end product could also be used. While simple esters and triglycerides of malvalic and sterculic acids will be used in the ensuing description to illustrate the invention, it is understood that others within the scope of the general formula given above can be similarly treated.

As mentioned above, the advantages of this invention are realized by conducting both the rearrangement and the hydrogenation reactions in the presence of a rhodium catalyst. Five percent rhodium on carbon has proven to be particularly effective, and it is expected that other forms of this catalyst would be substantially equivalent. The actual amount of catalyst required for a particular reaction may vary depending on the material being treated and the conditions of reaction. For purposes of the invention, an effective amount is defined as that quantity required to effect substantially quantitative rearrangement of the cyclopropenoid to conjugated diene, and/or reduction of the diene to its saturated branched derivative. This amount can be readily determined by a person in the art and will typically be on the order of about 0.5 and 1.0% (weight of rhodium metal against weight of reactant material).

The rearrangement reaction is conducted under nitrogen or other inert atmosphere in order to inhibit side reactions. For the same reason, decane or a similar solvent should be chosen as the reaction medium. The temperature should be maintained within the range of about 90°-200° C., with the range of about 130°-160° C. being preferred. Reaction time will vary inversely with temperature from about 2 to about 10 hr. and will typically be about 4-6 hr. at 150° C. As a result of such treatment, the cyclopropenoid starting material is converted substantially quantitatively to methyl- and/or methylene-branched conjugated dienes. In the case of sterculate, the following rearrangement products are formed:

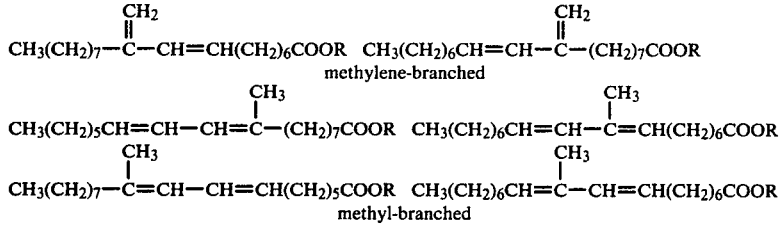

methylene-branched methyl-branched

The conjugated dienes resulting from the rearrangement of other cyclopropenoid compounds within the scope of the general formula given above would be similarly distributed. Recovery of the dienes is accomplished by any conventional methods of filtering out the catalyst and removing the solvent.

In the preparation of the saturated, branched chain derivatives, recovery of the dienes from the reaction medium is unnecessary. By simply substituting hydrogen for the inert atmosphere used in the rearrangement reaction, the hydrogenation can be conducted in the same vessel and with the same rhodium catalyst. The conditions of hydrogenation are not particularly critical. The hydrogen gas pressure may range from about atmospheric to 40 p.s.i.g. or more and the temperature can be in the range of from about 15° C. to about 200° C. The time required for complete reduction is inversely related to temperature and pressure and will vary from about 15 min. to about 3 hr. Under the preferred conditions of 30-40 p.s.i.g. at 25°-30° C., the time of reaction will be on the order of 30-60 min. As there is no evidence of isomerization during hydrogenation, the resultant branched chain derivatives will be the saturated counterparts of the methyl- and methylene-branched dienes described above. Yields of 90% or more of theoretical are generally obtainable for both the rearrangement and hydrogenation reactions.

The hydrogenation products are recovered by filtering to remove the catalyst and distillation of the solvent. Esterified products can either be recovered as such or hydrolyzed to the free fatty acid form. Once in the acid form, products containing straight chain fatty acids originating from the starting material can be purified by recrystallization from 80% aqueous ethanol. The ethanol precipitates the straight chain compounds and is then removed by distillation from the branched chain fatty acids in the filtrate.

The following examples are intended only to further illustrate the invention and are not intended to limit the scope of the invention which is defined by the claims.

EXAMPLE 1

A. Extraction of sterculia seed oil

A batch of sterculia seeds weighing 204.9 g. was shelled and the 105.3 g. of seed kernel obtained therefrom was crushed and allowed to stand overnight at room temperature in 500 ml. petroleum ether. After filtration of the miscella and removing the petroleum ether with a vacuum pump at 40°-50° C., 48.6 g. of the crude sterculia oil was obtained. The crude oil was then alkali refined to remove free fatty acids by washing in 200 ml. of 1% KOH.

B. Preparation of sterculia oil methyl ester

Forty grams of the alkali-refined sterculia oil from step (A) was combined with 200 g. methyl alcohol and 0.6 g. sodium methoxide in a three-necked flask and was transesterified at 49°–51° C. in a nitrogen atmosphere. The reaction was terminated after 3 hr. when the mixture became clear and was substantially free of triglyceride as determined by thin-layer chromatography. The reaction product was washed and stripped of solvent to yield 37.2 g. sterculia methyl ester.

EXAMPLE 2

Rearrangement of sterculia oil ester

The sterculia methyl ester prepared in Example 1 was rearranged in one run using the rhodium catalyst of this invention, and for purposes of comparison, it was rearranged in another run using palladium catalyst. The catalysts were 5% rhodium on carbon (aged 5 yr.) and 5% palladium on carbon (aged 15 yr. as favorable for the rearrangement reaction). For each run, methyl sterculate (5.0 g. for rhodium reaction, 3.0 g. for palladium reaction), 100 ml. decane, and 0.3 g. catalyst were added to a three-necked flask equipped with a stirrer, and the mixture was heated at 149°–152° C. in a nitrogen atmosphere. The reaction was continued for 9 hr. with 6-ml. samples taken at 2, 4, 6, and 9 hr. After filtering out the catalyst and removing the solvent by vacuum pump, each sample was analyzed by capillary-GC for conjugated diene. The results are reported in Tables IA and IB below.

EXAMPLE 3

Hydrogenation of rearrangement product

Both the rhodium- and palladium-catalyzed rearrangement reaction mixtures, including the methyl esters, catalyst and solvent, were transferred to hydrogenation vessels and reacted at room temperature in the presence of $H_2$ at 40 p.s.i.g. The hydrogenation time of the rhodium-rearranged product was 1 hr. and that for the palladium-rearranged product was 3 hr.

TABLE IA

| Peak No. | E.C.L.[a] | Methyl ester | Percent of total composition as related to reaction time: 0 hr. | 2 hr. Rh | 2 hr. Pd | 4 hr. Rh | 4 hr. Pd | 6 hr. Rh | 6 hr. Pd | 9 hr. Rh | 9 hr. Pd |
|---|---|---|---|---|---|---|---|---|---|---|---|
| 1 | 16.0 | palmitate | 16.8 | 19.9 | 19.4 | 19.5 | 19.8 | 19.8 | 21.2 | 20.5 | 21.0 |
| 2 | 18.0 | stearate | 1.6 | 2.4 | 2.0 | 2.2 | 2.2 | 2.5 | 2.2 | 2.5 | 2.3 |
| 3 | 18.3 | malvalate | 6.7 | 1.7 | 3.6 | 0.3 | 1.9 | 0.0 | 1.4 | 0.0 | 0.9 |
| 4 | 18.5 | oleate | 4.2 | 5.3 | 4.9 | 5.2 | 5.1 | 4.8 | 5.4 | 5.2 | 5.3 |
| 5 | 18.7 | C-18 conjugated diene[b] | 1.0[c] | 4.0 | 2.9 | 5.1 | 3.0 | 3.1 | 3.4 | 3.7 | 2.6 |
| 6 | 19.1 | sterculate | 53.9 | 14.3 | 26.7 | 3.4 | 17.5 | 0.8 | 11.3 | 0.3 | 5.9 |
| 7 | 19.3 | linoleate | 6.5 | 5.7 | 6.1 | 6.1 | 7.0 | 5.9 | 6.5 | 6.2 | 6.5 |
| 8,9, 10,11 | 19.6,20.6, 20.9,21.9 | C-19 conjugated diene[b] | 9.3[c] | 46.7 | 34.4 | 58.2 | 43.5 | 63.1 | 48.6 | 61.6 | 55.5 |

[a]Equivalent chain length, defined as a retention index corresponding to the number of carbon atoms in the fatty acid chain for the saturated, straight-chain esters.
[b]C-18 conjugated diene = rearrangement product of malvalate; C-19 conjugated diene = rearrangement product of sterculate.
[c]Rearrangement products may be inherent in sterculia oil and/or may have formed during GC analysis.

TABLE IB

| Rearrangement reaction | % Rearrangement[a] Rh | % Rearrangement[a] Pd |
|---|---|---|
| Malvalate to C-18 conjugated diene | 40.3 | 23.9 |
| Sterculate to C-19 conjugated diene | 97.0 | 86.2 |
| Combined cyclopropenoids to combined conjugated diene | 90.8 | 78.9 |

TABLE IB-continued

[a]% Rearrangement =

$$\frac{\%\ \text{conjugated diene}_{9\text{-}hr.} - \%\ \text{conjugated diene}_{0\text{-}hr.}}{\%\ \text{cyclopropenoid}_{0\text{-}hr.}} \times 100,$$

as taken from Table IA.

Inasmuch as hydrogenation by palladium is favored by unaged catalyst, 0.3 g. of fresh, unaged 5% palladium on carbon was added to the latter reaction mixture after the initial 3-hr. treatment, and it was hydrogenated a second time at room temperature and 30–40 p.s.i.g. $H_2$ pressure for 2 hr. Samples taken from this and the previous hydrogenations were analyzed by capillary-GC after removal of the catalyst and solvent. The results are shown in Table II, below. Table III gives the overall yields for the combined rearrangement and hydrogenation reactions by which the C-18 and C-19 cyclopropenoids (malvalate and sterculate) and the C-18 and C-19 conjugated dienes in the sterculia methyl ester were converted to the saturated, branched chain derivatives.

EXAMPLE 4

Recovery Procedure

A portion of the branched chain esters from the rhodium-catalyzed hydrogenation was hydrolyzed with an excess of 5% potassium hydroxide in 95% ethanol. The hydrolysis product was acidified with 20% HCl and washed with aqueous ether. After the branched chain fatty acids were separated from the wash and dried in vacuo, they were dissolved in 80% ethanol and allowed to stand overnight at about 4° C. A crystalline sediment formed at the bottom and was separated by filtration. Of the fatty acids separated from the filtrate by distillation, 83.5% were C-18 and C-19 saturated branched chain, as compared to 13.4% branched chain material in the crystalline phase. The branched chain fatty acid fraction isolated from the filtrate was characterized by an acid value of 189.9 (mg. KOH/g.) and a melting point of 21.1°–22.5° C.

EXAMPLE 5

Sterculia oil branched chain fatty acids prepared as in the preceding examples, oleic acid ("Pamolyn 100"), and isostearic acid ("Emersol 871") were each esterified with 2-ethylhexanol. For each preparation, the reactant acid was distilled and then combined in the proportions indicated in Table IV below with 2-ethylhexanol and the catalyst p-toluenesulfonic acid in a three-necked flask equipped with an agitator.

TABLE II

| Peak | E.C.L.[a] | Methyl ester | Percent of total composition Rh | Aged Pd | Unaged Pd |
|---|---|---|---|---|---|
| a | 16.0 | palmitate | 17.2 | 22.7 | 22.9 |
| b | 17.1 | C-18 branched chain | 6.6 | 3.4 | 6.2 |
| c | 18.0 | stearate | 12.7 | 16.4 | 15.8 |
| d | 18.3 | C-19 branched chain | 58.8 | 26.0 | 47.1 |
| e,f | 18.4, 18.6 | partially hydrogenated conjugated dienes | 2.9 | 25.3 | 2.4 |
| g | 19.0 | unknown | 1.8 | 6.2 | 5.6 |

[a]Equivalent chain length, defined as a retention index corresponding to the number of carbon atoms in the fatty acid chain for the saturated, straight-chain fatty esters.

TABLE III

| Branched fatty ester | % Conversion[a] Rh | Aged Pd | Aged Pd and unaged Pd |
|---|---|---|---|
| C-18 | 85.7 | 44.2 | 80.5 |
| C-19 | 93.0 | 41.1 | 74.5 |
| Combined C-18 and C-19 | 92.0 | 41.5 | 75.2 |

[a]% Conversion = $\frac{\text{\% branched chain esters}}{\text{\% cyclopropenoid}_{0\text{-}hr.} + \text{\% conjugated diene}_{0\text{-}hr.}} \times 100$, as taken from Tables IA and II.

TABLE IV

| Reactant | Oleic acid ester | Isostearic acid ester | Branched chain fatty acid ester |
|---|---|---|---|
| Oleic acid (g.) | 50 | — | — |
| Isostearic acid (g.) | — | 50 | — |
| Branched chain FA (g.) | — | — | 10 |
| 2-Ethyl hexanol (g.) | 46 | 46 | 10 |
| p-Toluenesulfonic acid (g.) | 0.3 | 0.3 | 0.06 |

In each case, the equivalent ratio of alcohol to fatty acid was 1.1:1. The reactions were conducted at 199°-221° C. for 4.25 hr. The resultant products were washed with 1% KOH to remove the excess acids followed by removal of excess 2-ethylhexanol. The crude esters were then purified by vacuum distillation and evaluated. The properties of the respective esters are reported below in Table V.

EXAMPLE 6

Branched chain fatty acids prepared as in the preceding examples, oleic acid ("Pamolyn 100"), and isostearic acid ("Emersol 871") were each esterified with trimethylolpropane. For each preparation, the reactant acid was distilled and then combined in the proportions indicated in Table VI below with trimethylolpropane, p-toluenesulfonic acid, and xylene in a three-necked flask equipped with an agitator and a Dean-Stark trap. In each case, the equivalent ratio of alcohol:acid was 1:1.1. The reaction was conducted in an atmosphere of nitrogen at a temperature of 200°-220° C. for 5 hr. The resultant products were washed with 1% KOH to remove the excess acids followed by washing with water until the wastewater became neutral. The esters were dried under vacuum and bleached with 3% activated clay at 110°-115° C. for 15 min. in vacuo. The properties of the respective esters are reported below in Table VII.

EXAMPLE 7

A. Rearrangement of sterculia fatty acids

Sterculia fatty acids (1.2 g.) obtained from the hydrolysis of sterculia oil, 24 ml. decane, and 0.12 g. of 5% rhodium on carbon were added to a three-necked flask equipped with an agitator, and the mixture was heated at 148°-152° C. in a nitrogen atmosphere for 6 hr. A 5-ml. sample of the resultant reaction mixture was filtered, stripped of solvent, methyl-esterified with diazomethane, and analyzed with capillary-GC. The results are reported in Table VIII, below. The percent rearrangement of malvalic and sterculic acids to their corresponding dienes was 37.3% and 92.2%, respectively, with a combined cyclopropenoid rearrangement of 86.1%.

TABLE V

Properties of 2-Ethylhexyl Alcohol Esters

| Property | Oleic acid ester | Isostearic acid ester | Branched chain fatty acid ester |
|---|---|---|---|
| Acid value (mg. KOH/g.) | <0.1 | <0.1 | <0.1 |
| Color (Gardner) | <1 | 2 | <1 |
| Viscosity (cSt., 37.8° C.) | 9.65 | 13.14 | 12.94 |
| Freezing point (°C.) | −36 | −25 | −41 |
| Pour point (°C.) | −39 | −28 | −43 |
| Wear scar diameter (mm.) | 0.391 | 0.431 | 0.470 |
| Coefficient of friction | 0.121 | 0.108 | 0.109 |

TABLE VI

| Reactant | Oleic acid ester | Isostearic acid ester | Branched chain fatty acid ester |
|---|---|---|---|
| Fatty acid (g.) | 40 | 40 | 20 |
| Trimethylolpropane (g.) | 5.76 | 5.21 | 2.75 |
| p-Toluenesulfonic acid (g.) | 0.24 | 0.24 | 0.12 |
| Xylene (ml.) | 5 | 5 | 3 |

TABLE VII

Properties of Trimethylolpropane Esters

| Property | Oleic acid ester | Isostearic acid ester | Branched chain fatty acid ester |
|---|---|---|---|
| Acid value (mg. KOH/g.) | <0.1 | <0.1 | <0.1 |
| Color (Gardner) | <1 | 3 | <1 |
| Viscosity (cSt., 37.8° C.) | 53.5 | 103.4 | 93.6 |
| Freezing point (°C.) | −35 | −15 | −38 |
| Pour point (°C.) | −36 | −16 | −38 |
| Wear scar diameter (mm.) | 0.607 | 0.552 | 0.484 |
| Coefficient of friction | 0.100 | 0.127 | 0.106 |

TABLE VIII

| Peak No. | E.C.L.[a] | Fatty acid | Percent of total composition 0 hr. | 6 hr. |
|---|---|---|---|---|
| 1 | 16.0 | palmitic | 16.8 | 22.2 |
| 2 | 18.0 | stearic | 1.6 | 2.5 |
| 3 | 18.3 | malvalic | 6.7 | 0.4 |
| 4 | 18.5 | oleic | 4.2 | 5.2 |
| 5 | 18.7 | C-18 conjugated diene[b] | 1.0[c] | 3.5 |
| 6 | 19.1 | sterculic | 53.9 | 0.2 |
| 7 | 19.3 | linoleic | 6.5 | 7.0 |
| 8,9 | 19.6,20.6, | C-19 conjugated | 9.3[c] | 59.0 |

TABLE VIII-continued

| Peak No. | E.C.L.[a] | Fatty acid | Percent of total composition 0 hr. | 6 hr. |
|---|---|---|---|---|
| 10,11 | 20.9,21.9 | diene[b] | | |

[a]Equivalent chain length, defined as a retention index corresponding to the number of carbon atoms in the fatty acid chain for the saturated, straight-chain ester.
[b]C-18 conjugated diene = rearrangement product of malvalic acid; C-19 conjugated diene = rearrangement product of sterculate.
[c]Rearrangement products may be inherent in sterculia oil and/or may have formed during GC analysis.

B. Hydrogenation of rearrangement product

The reaction mixture from Example 7A above was hydrogenated at room temperature by substituting hydrogen gas at atmospheric pressure for the nitrogen in the three-necked flask, and reacting for 2 hr. After filtering out the catalyst and stripping the solvent, a sample of hydrogenation product was methyl-esterified with diazomethane and analyzed by capillary-GC. The analysis indicated incomplete hydrogenation, suggesting that more stringent conditions are required when the rearrangement product is in the acid form.

It is understood that the foregoing detailed description is given merely by way of illustration and that modification and variations may be made therein without departing from the spirit and scope of the invention.

We claim:

1. A method for producing conjugated diene derivatives of a cyclopropenoid compound comprising heating said cyclopropenoid compound in the presence of a rhodium catalyst in an inert atmosphere under conditions suitable for the rearrangement of said compound to said conjugated diene derivatives.

2. A method as described in claim 1 wherein said cyclopropenoid compound is a fatty acid ester.

3. A method as described in claim 2 wherein said fatty acid ester is selected from the group consisting of malvalic acid esters, sterculic acid esters, and mixtures thereof.

4. A method as described in claim 2 wherein said fatty acid ester is a triglyceride.

5. A method as described in claim 4 wherein said triglyceride is sterculia oil.

6. A method for producing saturated, branched chain derivatives of a cyclopropenoid compound comprising the steps of:

a. heating sid cyclopropenoid compound in the presence of a rhodium catalyst and in an inert atmosphere under conditions suitable for the rearrangement of said compound to branched, conjugated diene intermediates;

b. reacting said conjugated diene intermediates with hydrogen in the presence of a rhodium catalyst under conditions sufficient to effect substantially complete hydrogenation of said dienes, thereby yielding said saturated, branched chain derivatives; and c. recovering the derivatives produced in step (b).

7. A method as described in claim 6 wherein said cyclopropenoid compound is a fatty acid ester.

8. A method as described in claim 7 wherein said fatty acid ester is selected from the group consisting of malvalic acid esters, sterculic acid esters, and mixtures thereof.

9. A method as described in claim 7 wherein said fatty acid ester is a triglyceride.

10. A method as described in claim 9 wherein said triglyceride is sterculia oil.

11. A method for producing saturated, branched chain derivatives of a cyclopropenoid fatty acid ester comprising the steps of:

a. preparing a reaction mixture comprising said cyclopropenoid fatty acid ester and a rhodium catalyst;

b. heating said reaction mixture in an inert atmosphere under conditions suitable for the rearrangement of said ester to branched, conjugated diene intermediates;

c. contacting the reaction mixture resulting from the rearrangement of step (b) with hydrogen, and reacting said conjugated diene intermediates and said hydrogen in the presence of said rhodium catalyst of step (a) under conditions sufficient to effect substantially complete hydrogenation of said dienes, thereby yielding said saturated, branched chain derivatives; and d. recovering the derivatives produced in step (c).

12. A method as described in claim 11 wherein said fatty acid ester is selected from the group consisting of malvalic acid esters, sterculic acid esters, and mixtures thereof.

13. A method as described in claim 11 wherein said fatty acid ester is sterculia oil.

* * * * *